United States Patent [19]

Astarita

[11] 4,162,578

[45] Jul. 31, 1979

[54] T-SQUARE

[76] Inventor: Emmanuel G. Astarita, 107-2 Dune Grassway, Downsview, Ontario, Canada, M3N 3X2

[21] Appl. No.: 912,294

[22] Filed: Jun. 5, 1978

[51] Int. Cl.[2] ..... B43L 13/02

[52] U.S. Cl. ..... 33/443

[58] Field of Search ..... 33/76, 75 R, 79 R, 80, 33/81, 104, 107, 111, 112, 113, 174 M; 362/23, 31, 109; 116/DIG. 36

[56] References Cited

U.S. PATENT DOCUMENTS

| | | | |
|---|---|---|---|
| 353,477 | 11/1886 | Bloemker | 33/80 |
| 1,404,000 | 1/1922 | Barber | 33/80 |
| 2,511,654 | 6/1950 | Spoor | 33/80 |
| 2,574,463 | 11/1951 | Chapin | 33/80 |
| 2,854,751 | 10/1958 | Casey | 33/80 |
| 2,908,081 | 10/1959 | Burke | 33/107 R |
| 2,954,609 | 10/1960 | Goertz | 33/80 |
| 4,075,467 | 2/1978 | Peterson | 362/31 |

FOREIGN PATENT DOCUMENTS

| | | | |
|---|---|---|---|
| 7233 | 4/1902 | Austria | 33/80 |
| 817854 | 10/1951 | Fed. Rep. of Germany | 33/76 R |
| K 26602 | 10/1956 | Fed. Rep. of Germany | 33/76 R |
| 1212821 | 10/1959 | France | 33/107 R |

*Primary Examiner*—Harry N. Haroian

*Attorney, Agent, or Firm*—Fetherstonhaugh & Co.

[57] ABSTRACT

An improved T-square which is self-supporting consists of a main body and a carriage. The main body consists of an elongated straight edge member having a head at one end thereof formed with a mounting channel for receiving a marginal edge portion of a drawing board for movement therealong. The carriage has a second mounting channel formed therein for engaging a support rail which is spaced from the first edge of the drawing board. The carriage is movable along the support rail. A resilient tensioning device is provided which connects the carriage to the main body. A luminaire chamber is formed in the main body in close proximity to the straight edge and a luminaire is operatively mounted in the luminaire chamber to illuminate the straight edge of the body. In addition, a sensor is provided for detecting improper alignment of the T-square with respect to the board on which it is mounted.

6 Claims, 17 Drawing Figures

FIG 1
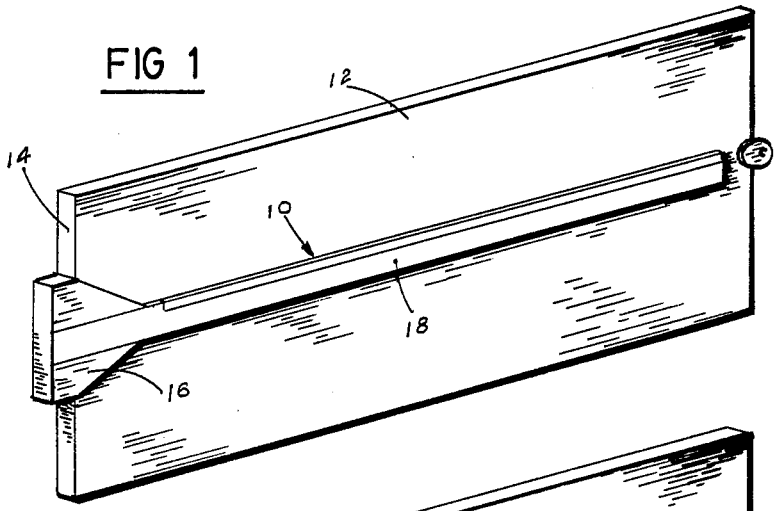
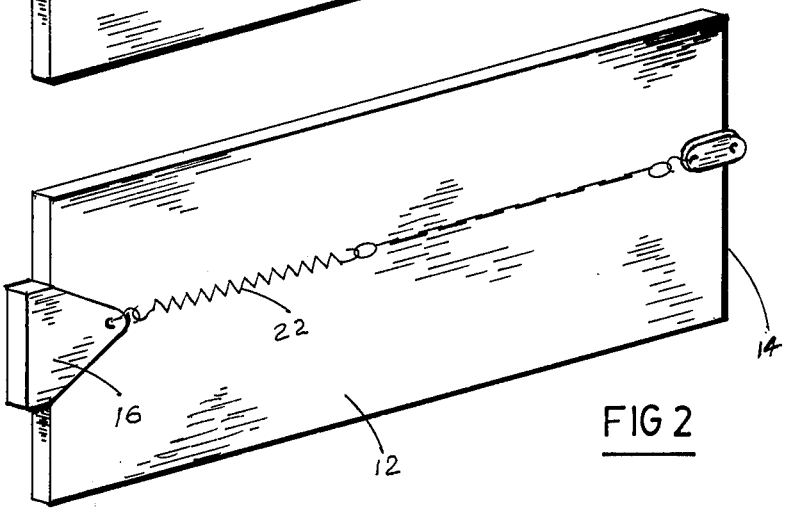
FIG 2
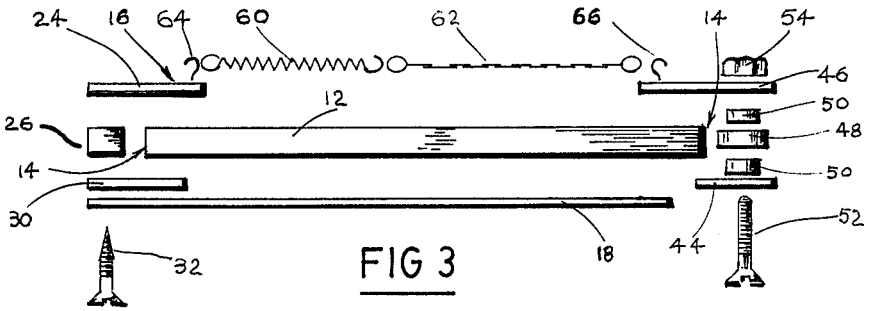
FIG 3

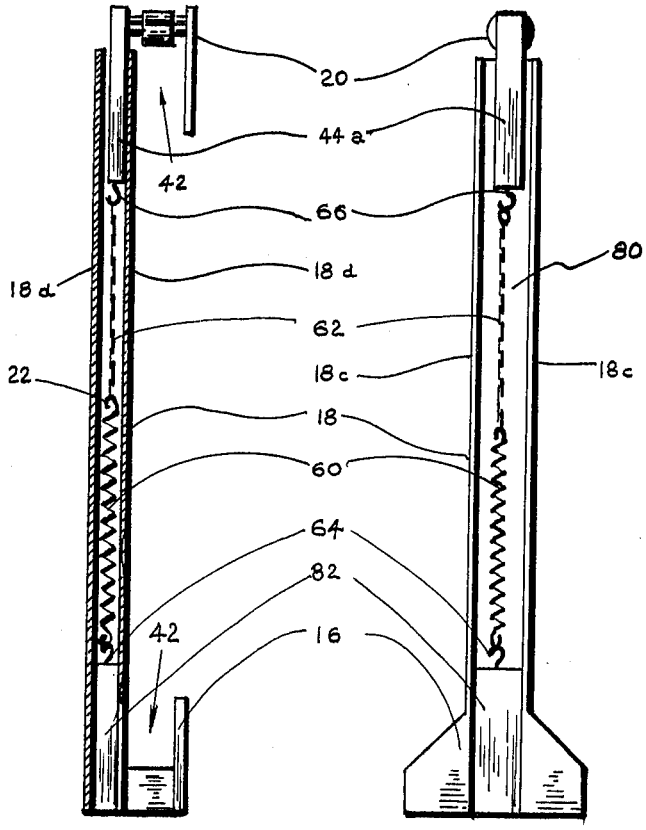
FIG 7
FIG 8
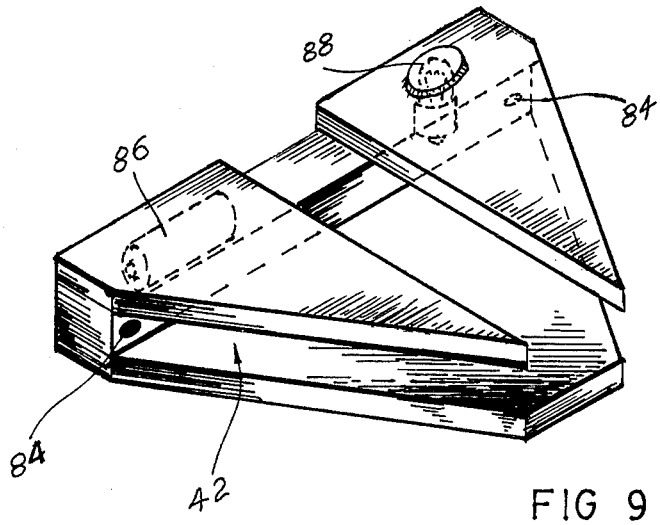
FIG 9

FIG 14
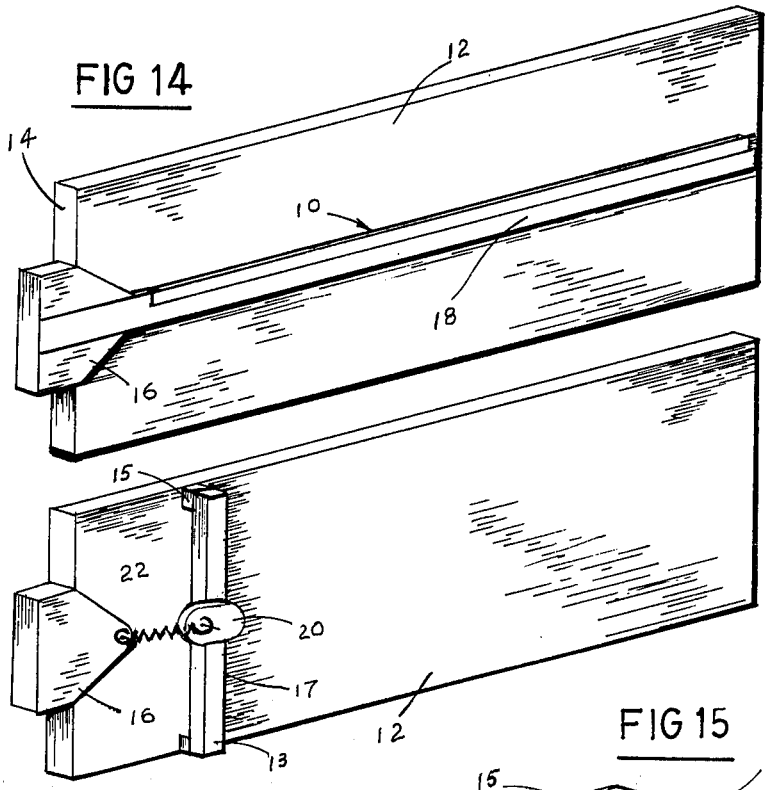
FIG 15
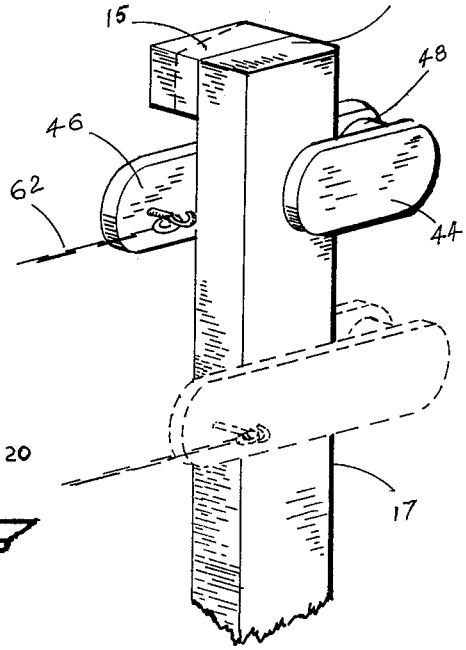
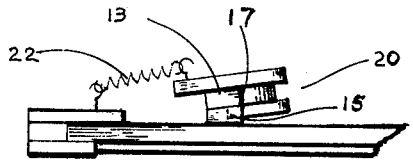
FIG 16
FIG 17

T-SQUARE

FIELD OF INVENTION

This invention relates to improvements in T-squares. The improvements include the provision of a structure which makes the T-square self-supporting and a structure which provides a signal indicating when the T-square is not correctly aligned and a structure which serves to illuminate the area of the T-square surrounding the straight edge and a structure which provides for variation in the resistance of movement of the T-square along a drawing board.

PRIOR ART

While self-supporting T-squares are presently available, they employ a complex mechanism which must be mounted on a drawing board. Some such mechanisms include tensioning springs and/or weights for supporting the T-square at any position on a drawing board. These mechanisms are expensive to manufacture.

The traditional T-square which consists merely of a head and a straight edge member is inexpensive to manufacture but it is not self-supporting and is, therefore, difficult to use on drawing boards which are not substantially horizontally disposed.

It is frequently difficult to determine when a T-square is out of alignment with a datum face of a drawing board. With the traditional T-square it is necessary to ensure that the head is firmly engaged along its full length with the edge of the drawing board. Difficulty is frequently experienced in maintaining the required relationship when the T-square is in use and lines are being drawn at an area spaced inwardly from the head. In the expensive T-square mechanisms described above, the edge of the drawing board is not used as a datum edge, with the result that the straight edge can become misaligned or can change its alignment during use with the changes not being easily detected.

In many circumstances, the straight edge of a T-square can cast a shadow on the underlying portion of the drawing board so that in this immediate area, which is the critical area when the T-square is in use, the lighting is frequently substantially poorer than that at other areas of the drawing board.

One object of the present invention is to provide a T-square which is self-supporting.

A further object of the present invention is to provide a T-square in which a variable pressure may be applied to the drawing board to vary the resistance to movement of the T-square with respect to the drawing board.

A further object of the present invention is to provide a T-square which includes a sensor mechanism for sensing when the T-square is correctly aligned on a drawing board.

Yet another object of the present invention is to provide a T-square which incorporates a luminaire for illuminating a portion of the drawing board disposed at the straight edge of the T-square.

While I have described the various objects of the present invention in the preceding paragraphs, it is to be noted that while a T-square may be constructed in accordance with the preferred embodiment of the present invention, to achieve all of the above objectives a T-square may also be constructed according to further embodiments of the invention to achieve any one of the above objects without achieving any of the other objectives.

SUMMARY OF INVENTION

According to one aspect of the present invention, there is provided a self-supporting T-square which comprises a main body consisting of an elongated straight edge member having a head at one end thereof formed with a first mounting channel opening laterally towards the other end of the straight edge member, said channel having restraining faces adapted to receive a first guide rail at a first marginal edge portion of a drawing board for movement therealong, a carriage having a second mounting channel formed therein, said second mounting channel opening towards said first mounting channel of said head and being adapted to receive a second guide rail which extends parallel to and is spaced laterally from said first marginal edge portion of a drawing board for movement therealong, resilient tensioning means connecting said carriage and said main body, said resilient tensioning means being adapted to urge said carriage towards said body to clamp said T-square to a drawing board in use.

According to a further aspect of the present invention, there is provided a self-supporting T-square as described in the preceding paragraph which includes adjustable pressure pad means mounted on the head for movement towards and away from the drawing board in use to vary the resistance to movement of the main body with respect to the drawing board.

According to yet another aspect of the present invention, there is provided in a T-square which includes a main body having a head and an elongated straight edge member the improvement of sensor means mounted on the head for detecting correct alignment of the head with respect to an edge of the drawing board and signal means responsive to a signal from the sensor means to provide a signal indicating when the head is not correctly aligned.

According to yet another aspect of the present invention, there is provided in a T-square which consists of a head and a straight edge member projecting from the head, the straight edge member having a first longitudinal edge, a luminaire chamber in the main body coextensive with at least a major portion of the first longitudinal edge, luminaire means in said luminaire chamber and means for transmitting light from said luminaire through said first longitudinal edge to illuminate the area immediately surrounding said first longitudinal edge.

PREFERRED EMBODIMENTS

The invention will be more clearly understood after reference to the following detailed specification read in conjunction with the drawings, wherein FIG. 1 is a pictorial front view of a T-square constructed in accordance with an embodiment of the present invention mounted on a drawing board;

FIG. 2 is a back view of the T-square and drawing board assembly of FIG. 1;

FIG. 3 is an exploded side view of a T-square and drawing board;

FIG. 7 is a side view with removed cover of a T-square constructed in accordance with a further embodiment of the present invention;

FIG. 8 is a top view of the T-square of FIG. 7 with the upper cover removed to expose the tensioning means;

FIG. 9 is a pictorial view of a T-square head constructed in accordance with a further embodiment of the present invention;

FIGS. 14, 15 and 16 are views corresponding to FIGS. 1, 2 and 3, respectively, illustrating a further embodiment of the present invention; and FIG. 17 is an enlarged detail view illustrating the manner in which a carriage is mounted on a guide rail.

Figure 4:
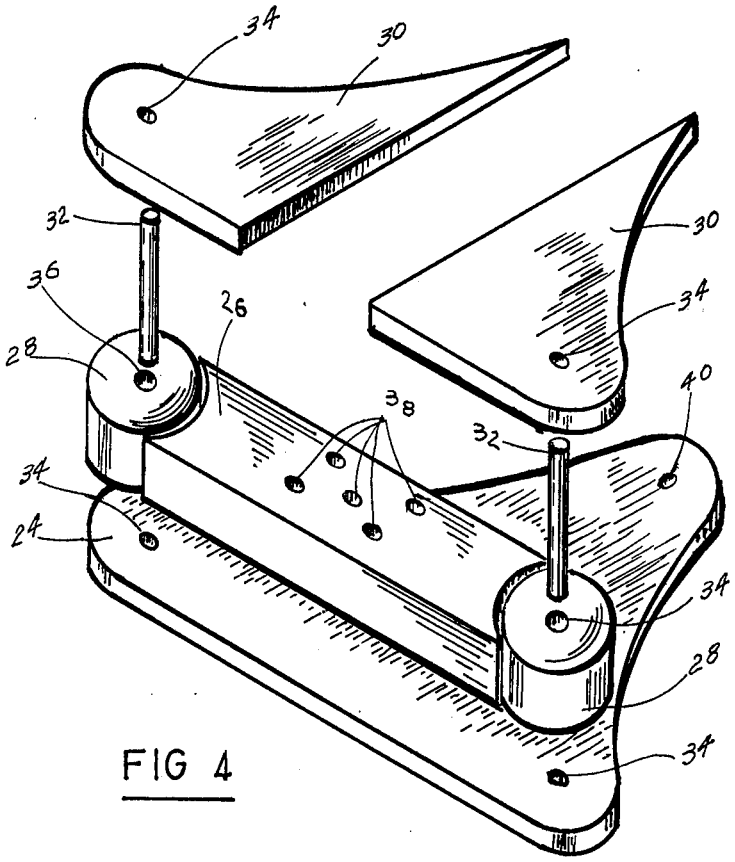
FIG. 4 is an exploded detail view of the head of a T-square.

With reference to FIG. 1 of the drawings, the reference numeral 10 refers generally to a T-square which is self-supporting on a drawing board 12. The drawing board 12 has oppositely disposed side edges 14 which, in this embodiment, form a track or guide rail along which the T-square assembly is guided when it is moved relative to the drawing board. The T-square 10 includes a head 16, a straight edge member 18, a carriage 20 and a resilient tensioning assembly 22 (FIG. 2). The structure of a head suitable for use in association with the T-square is illustrated in FIG. 4 of the drawings. With reference to FIG. 4, it will be seen that the head includes a back plate 24, a guide rail 26, a pair of guide rollers 28, a pair of face plates 30 and a pair of roller support shafts 32. The back plate 24 and face plates 30 each have passages 34 opening therethrough to receive the roller support shafts 32 and each roller 28 has a passage 36 opening therethrough which is adapted to receive the support shafts 32 so that the rollers 28 are mounted for rotation on the shafts 32 when the head is assembled. The rail 26 has a plurality of threaded passages 38 located substantially centrally thereof for use in mounting the straight edge member as will be described hereinafter. The back plate 24 also has a passage 40 opening therethrough to receive one end of the resilient tensioning assembly 22.

In the embodiment illustrated in FIG. 4, two guide rollers 36 are provided. The guide rollers 36 serve to permit the head of the T-square to move freely along an edge 14 of a drawing board by rotating as the T-square is moved relative to the board. It will be understood, however, that while these rollers have an advantage in some applications, the head of the T-square might conveniently be constructed without any rollers to increase the drag of the head or with only one roller. The bar 26 co-operates with the back plate 24 and the face plates 30 to form a U-shaped channel to receive a marginal edge portion of the drawing board. The U-shaped channel is identified by the reference numeral 42 in FIG. 9.

When the head is assembled, the back plate 24, bar 26 and face plates 30 may be secured to one another by a suitable mounting screw so they may be adhesively secured in the assembled configuration. It will, however, be apparent that the head may be a unitary molded element.

With reference to FIGS. 1 to 3 of the drawings, it will be seen that the carriage 20 includes a face plate 44, a back plate 46, a roller 48, a pair of spacers 50, a support shaft 52 and a locking nut 54. When assembled, the roller 48 is rotatable on the shaft for movement along an edge 14 of the drawing board and a U-shaped channel 42 (FIG. 7) is provided to receive the marginal edge of the drawing board.

The resilient tensioning assembly includes a tension spring 60 and a cable 62. One end of the tensioning spring 60 is releasably mounted on a hook 64 which is secured in the passage 40 of the back plate 24 and the other end of the tensioning spring 60 is secured to one end of the cable 62. The other end of the cable 62 is releasably secured to the hook 66 which is mounted on the back plate 46 of the carriage 20.

Figure 5:
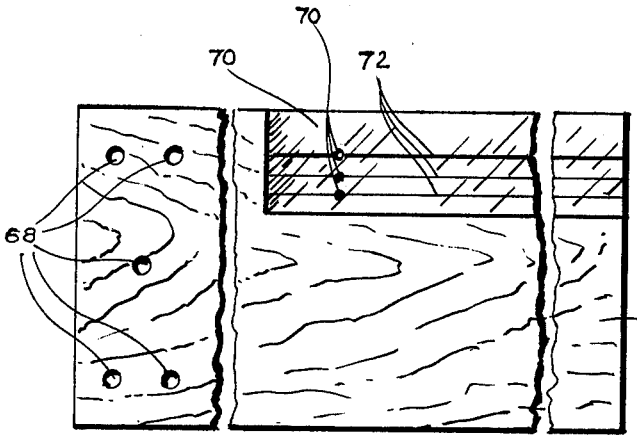
FIG. 5 is a front view of a straight edge member.
Figure 6:
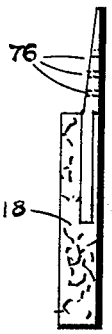
FIG. 6 is a side view of the straight edge member of FIG. 5.

With reference to FIGS. 1 and 5 of the drawings, it will be seen that the straight edge member 18 is formed with a plurality of passages 68 which are alignable with the passages 38 in the bar 26 for securing the straight edge member 18 with respect to the head. The straight edge member 18 is proportioned to fit between the face plate members 30 of the head so as to be retained in a position extending perpendicular to the datum plane established by the head. The straight edge member has a transparent insert 70 extending at one edge thereof. A plurality of line markings 72 extend longitudinally of the insert 70 parallel to the lining edge 74 thereof. A plurality of passages 76 open through the insert 70 at predetermined intervals therealong, the passages 76 being of a diameter sufficient to permit the lead of a drafting pencil to extend therethrough.

In the embodiment of the invention illustrated in FIGS. 1 through 6, the T-square is self-supporting by reason of the fact that the U-shaped channel formed in the head receives one edge of the drawing board and the U-shaped channel formed in the carriage receives the opposite edge of the drawing board and the tensioning means which extends across the back of the drawing board and which connects the head and the carriage draws the head and carriage towards one another into engagement with the opposite edges of the drawing board. It will be apparent that if the T-square is moved vertically with respect to the drawing board, the carriage will be drawn with it by the tensioning assembly which will tend to draw the carriage to a position disposed laterally opposite the T-square. The tension which is constantly maintained in the tension spring 22 in use is sufficient to cause the carriage 20 to move with the T-square although movement may be slightly delayed without adversely affecting the operation of the T-square.

The T-square described in FIGS. 1 through 6 of the drawings may have the disadvantage that the tensioning mechanism extends across the back of the drawing board. In many instances the support mechanism for supporting the drawing board in an upright position is mounted on the back of the drawing board so that it would not be possible to use this assembly on some drawing boards. This problem has been overcome in the second embodiment of the invention, as illustrated in FIGS. 7 and 8, and the third embodiment illustrated in FIGS. 14 to 17. In the embodiment illustrated in FIGS. 7 and 8, the straight edge member 18 is modified to include an inner wall member 18*a* and an outer wall member 18*b* and a pair of oppositely disposed side wall members 18*c* which cooperate with one another to form a chamber 80 extending longitudinally thereof. An anchor block 82 is mounted at the head end of the chamber 80. The carriage 20 has a back plate 44a which is adapted to fit in a loose fitting sliding relationship within the open end of the chamber 80. The remainder of the structure of the carriage 10 is the same as that previously described above. In this embodiment, the tensioning assembly 22 extends between the carriage 44a and the anchor block 82 within the chamber 80 and, consequently, this T-square assembly may be mounted on a drawing board which has supports on the back face thereof which would prevent the tensioning mechanism extending across the back of the drawing board.

In the embodiment of the invention illustrated in FIGS. 14 through 17 of the drawings, the carriage 20 is supported on a guide rail 17 which extends parallel to the side edge 14 of the drawing board on which the head 16 is mounted. The guide rail 17 is spaced outwardly from the back face of the drawing board by support blocks 15, the outer faces of which are inclined downwardly towards the edge 14 of the drawing board as shown in FIG. 16. The guide rail 17 serves the same purpose as the edge 14 of the drawing board illustrated in FIG. 1 in that its supports the carriage 20 in a spaced relationship with respect to the head 16. In this embodiment, however, it is not necessary for the mechanism connecting the carriage 20 to the head 16 to extend across the full width of the back of the drawing board and thus, with the addition of the guide rail 17, it is possible to utilize the self-supporting T-square on a drawing board which has a supporting frame mounted on the back face thereof.

FIG. 9 of the drawings illustrates a head of a T-square which may be used in association with any straight edge member and with or without the carriage to provide an indication that the straight edge is correctly aligned with respect to the edge of the drawing board. This mechanism is particularly suitable for use in association with a self-supporting T-square of the type previously described as it serves to give an indication that the T-square, when self-supported, is properly aligned. As shown in FIG. 9, contacts 84 and 84 are mounted on the inner face of the channel 42. The contacts 84 are wired in series with a source of electrical power such as a battery 86 and a signal light 88. The contacts 84 and 84 may be in the form of switches which are open when the contacts are out of engagement with the edge of a drawing board and which are closed when both are in engagement with the edge of a drawing board so that the signal light 88 is activated when the T-square is correctly aligned. Clearly, the signalling system described above may be modified so that the signal light is deactivated when the T-square is correctly aligned and is only activated when the T-square is out of correct alignment. This signal mechanism may be used to deactivate the luminaire system described hereinafter so that the T-square will not be properly illuminated unless it is correctly aligned.

Figure 10:
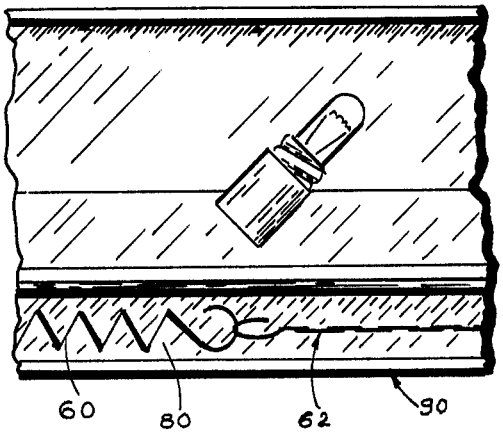
FIG. 10 is a sectioned plan view of a straight edge member constructed in accordance with a further embodiment of the present invention.
Figure 11:
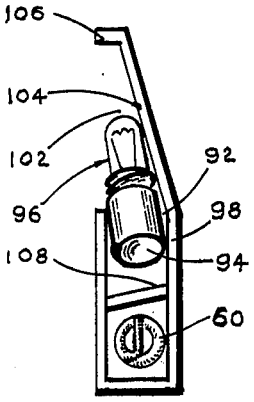
FIG. 11 is a sectional end view of the straight edge member of FIG. 10.

FIGS. 10 and 11 of the drawings illustrate a straight edge member which is adapted to provide illumination at the drawing edge thereof. The straight edge member 90 includes an illumination chamber 92 extending longitudinally thereof which includes bulb holders 94 at spaced intervals therealong for receiving electrical bulbs 96. The holders 94 are connected to a source of electrical power through suitable wiring (not shown) in any conventional manner. The chamber 92 has a removable top cover 98 to provide access thereto. A passage 102 permits light to pass therethrough. The straight edge member has a panel 104 projecting outwardly therefrom to a panel 106 which forms the drawing edge. A base panel 108 should be made of reflecting substance or painted to reflect light towards panel 106. The panel 106 is made from a translucent material so that light emitted from the luminaires 96 may pass therethrough to illuminate the adjacent portion of the drawing board. The panel 104 may also be translucent to permit the light to pass therethrough.

Figure 12:
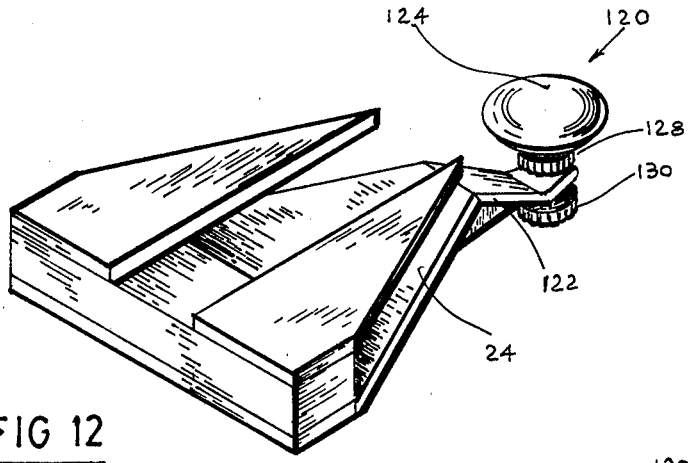
FIG. 12 is a pictorial view of a modified head assembly including a pressure applying mechanism.
Figure 13:
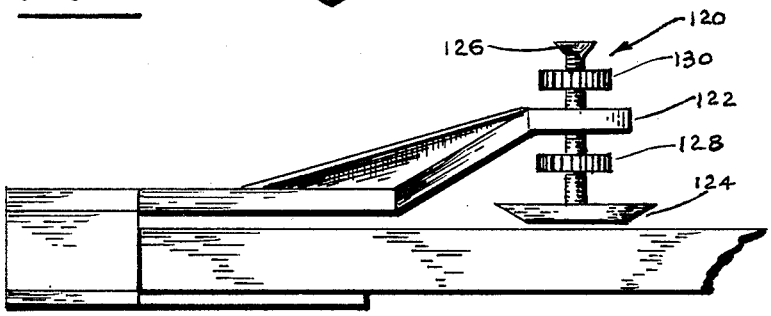
FIG. 13 is a side view of the head of FIG. 12 mounted on the edge of a drawing board.

FIGS. 12 and 13 serve to illustrate a mechanism for achieving a variable resistance to movement of the head 16 along the edge 14 of the drawing board 12. The variable resistance is achieved by means of a pressure pad assembly 120 which is mounted on a flange 122 which is formed as an extension of the back plate 24. The pressure plate, in the form of a disc 124, is mounted on a threaded shaft 126 which extends through a passage in the flange 122. Adjustment nuts 128 and 130 are threadably mounted on the shaft 126 and are adjustable longitudinally thereof to adjust the position of the pressure pad 124 with respect to the board 12. By directing the pressure pad 124 against the surface of the board 12, it is possible to increase the resistance to movement of the head 16 relative to the board.

From the foregoing it will be apparent that the present invention provides an inexpensive mechanism permitting a T-square to be self-supporting on a drawing board. The self-supporting mechanism may employ a tensioning mechanism which extends across the rear face of the drawing board or across parts thereof or it may employ a structure wherein the tensioning mechanism is mounted in a chamber extending longitudinally of the straight edge member. Clearly, the costs of manufacturing the self-supporting T-square according to the first embodiment in which the tensioning mechanism extends across the back or parts of the drawing board is less than that in the manufacture of the assembly in which the tensioning mechanism is slidably mounted in a chamber in the body of the straight edge member. On the other hand, the mounting of the tensioning mechanism in the body of the T-square permits the T-square to be self-supporting on a drawing board which does not have free space extending across the full width of the back face thereof, in which case the manner of assembly shown in FIGS. 14 to 17 may be employed.

It will also be apparent from the foregoing specification that a T-square constructed in accordance with another embodiment of the invention provides a signal when the head is not correctly positioned on the edge of the drawing board. While this system may be used in association with a T-square which does not include the carriage and self-supporting mechanism of the present invention, it is particularly suitable when used in combination with such a mechanism in which it is not necessary for the operator to hold the T-square against the edge of the drawing board.

It will also be apparent that the T-square constructed in accordance with yet another aspect of the invention provides for the illumination of the edge of the straight edge member so that even under conditions where the room lighting is not particularly good, adequate illumination will be provided in the area of the straight edge.

According to yet another aspect of the present invention, it will be seen that there is provided an adjustable pressure pad mechanism for adjusting the resistance to movement of the head of the T-square along the edge of the drawing board.

These and other aspects of the present invention will be apparent to those skilled in the art.

What I claim as my invention is:

1. A self-supporting T-square comprising:

(a) a main body consisting of an elongated straight edge member having a head at one end thereof formed with a first slipway channel extending longitudinally thereof and opening laterally toward the other end of said straight edge member, said channel having at least one longitudinally extending face thereof arranged to frictionally engage a marginal edge of a drawing board for sliding movement therealong, (b) a carriage which does not directly engage said main body, said carriage having a second mounting channel formed therein, said second mounting channel opening towards said first slipway channel of said head and being adapted to receive a support rail for movement therealong, (c) resilient tensioning means connecting said carriage and said main body, said resilient tensioning means being adapted to urge said carriage toward said main body, (d) said carriage being spaced from said main body and connected thereto solely by said resilient tensioning means whereby said main body may be moved freely along said first marginal edge and is displaceable relative to said carriage in the direction of movement along the marginal edge with said resilient tensioning means serving to urge said carriage towards lateral alignment with said head when said carriage is in engagement with a marginal edge of a drawing board in use.

2. A self-supporting T-square as claimed in claim 1 wherein said resilient tensioning means is connected to said head and said carriage in a plane which is spaced rearwardly from said straight edge member so as to extend on the opposite side of the drawing board to that in which said straight edge member is mounted.

3. A self-supporting T-square as claimed in claim 1 wherein said carriage includes a roller mounted in said second channel for engaging an edge of a drawing board to permit the carriage to move freely along the edge of the drawing board to be self-aligning with the main body in use.

4. A self-supporting T-square comprising, (a) a main body consisting of an elongated straight edge member having a head at one end thereof formed with a first mounting channel opening laterally towards the other end of the straight edge member, said channel having restraining faces adapted to receive a first marginal edge portion of a drawing board for movement therealong, (b) a carriage having a second mounting channel formed therein, said second mounting channel opening towards said first mounting channel of said head and being adapted to receive a support rail for movement therealong, (c) resilient tensioning means connecting said carriage and said main body, said resilient tensioning means being adapted to urge said carriage towards said body, to clamp said T-square to a drawing board in use, (d) sensor means in said base of said mounting channel of said head for detecting alignment of the head with respect to the edge of a drawing board, and (e) signal means responsive to a signal from said sensor means to provide a signal indicating when the head is not correctly aligned with respect to a marginal edge of the drawing board in use.

5. In combination, a drawing board and a self-supporting T-square, said drawing board comprising, (a) a generally planar board having first and second side edges extending longitudinally thereof, a front face and a back face, (b) a guide rail mounted on said back face and extending longitudinally of said board inwardly from said first side edge thereof, said guide rail being disposed adjacent said first side edge, said self-supporting T-square comprising, (a) a main body consisting of an elongated straight edge member having a head at one end thereof formed with a first slipway channel extending longitudinally thereof and opening laterally toward the other end of said straight edge member, said main body being mounted on said first marginal edge of said board with said first marginal edge extending within said channel, said main body being slideable along said first marginal edge, (b) a carriage having a second mounting channel formed therein, said second mounting channel opening toward said first slipway channel of said head, said carriage being mounted on said guide rail with said guide rail extending through said second mounting channel, (c) resilient tensioning means connecting said carriage to said main body, said resilient tensioning means urging said carriage toward said main body, said carriage being spaced from said main body and connected thereto solely by said resilient tensioning means whereby said main body may be moved freely along said first side edge independently of said carriage with said resilient tensioning means serving to urge said carriage toward lateral alignment with said head when said main body is moved relative to said drawing board in use.

6. A T-square comprising, a main body consisting of an elongated straight edge member having a head at one end thereof formed with a first mounting channel opening laterally towards the other end of said straight edge member, said channel having restraining faces adapted to receive a guide rail of a drawing board for movement therealong, sensor means in said mounting channel for detecting alignment of the head with respect to said guide rail, and signal means responsive to the sensor means to provide a signal when the head is not correctly aligned with respect to the guide rail in use.

* * * * *